US005333598A

United States Patent [19]

Mielke et al.

[11] Patent Number: 5,333,598

[45] Date of Patent: Aug. 2, 1994

[54] UNIT HEATER AND HEAT EXCHANGER THEREFOR

[75] Inventors: Richard A. Mielke, Franksville; Norman E. Mattson, Racine; Robert S. Cooley, Oconomowoc, all of Wis.

[73] Assignee: Modine Manufacturing Co., Racine, Wis.

[21] Appl. No.: 885,546

[22] Filed: May 19, 1992

[51] Int. Cl.[5] ..... F24H 3/00

[52] U.S. Cl. ..... 126/116 R; 126/99 R

[58] Field of Search ..... 126/99 R, 110 R, 116 R, 126/116 A, 110 D; 165/170

[56] References Cited

U.S. PATENT DOCUMENTS

| | | | |
|---|---|---|---|
| 3,073,296 | 1/1963 | Hollingsworth et al. | 126/110 R |
| 3,258,004 | 6/1966 | Bedell et al. | 126/110 R |
| 3,297,079 | 1/1967 | Blumenshine | 126/116 B X |
| 3,502,142 | 3/1970 | McGuffey | 165/170 |
| 4,006,728 | 2/1977 | Nishi et al. | 126/110 R |
| 4,467,780 | 8/1984 | Ripka . | |
| 4,474,172 | 10/1984 | Burke | 126/674 X |
| 4,982,785 | 1/1991 | Tomlinson | 126/110 R |
| 5,080,166 | 1/1992 | Haugeneder | 165/170 |
| 5,113,844 | 5/1992 | Cook | 126/110 R |

FOREIGN PATENT DOCUMENTS

| | | |
|---|---|---|
| 1520628 | 2/1967 | France . |
| 2019549 | 10/1979 | United Kingdom . |

*Primary Examiner*—Carl D. Price

*Attorney, Agent, or Firm*—Wood, Phillips, VanSanten, Hoffman & Ertel

[57] ABSTRACT

Poor heat exchange in a heat exchanger between a flue gas passing through the heat exchanger and air being forced through the heat exchanger can be improved in a heat exchanger and combustor (30) for exchanging heat between a forced air stream and a flue gas generated by a plurality of spaced, parallel burners (44) with a construction including spaced, upper and lower headers (32, 34), a plurality of tubes (50), one for each burner (44) extending in parallel between and mounted to the headers (32, 34). Each tube 50 has a first section (56) of enlarged cross section adapted to serve as a combustor for fuel to generate the flue gas and a narrowed, second section (70) for exchanging heat between the flue gas and the forced air stream. Each second section includes generally flat, parallel spaced walls (58, 60) with each of the walls (58, 60) having dimples (74) therein which are directed toward the other of the walls (58, 60) into substantially contacting or almost contacting relationship therewith.

5 Claims, 2 Drawing Sheets

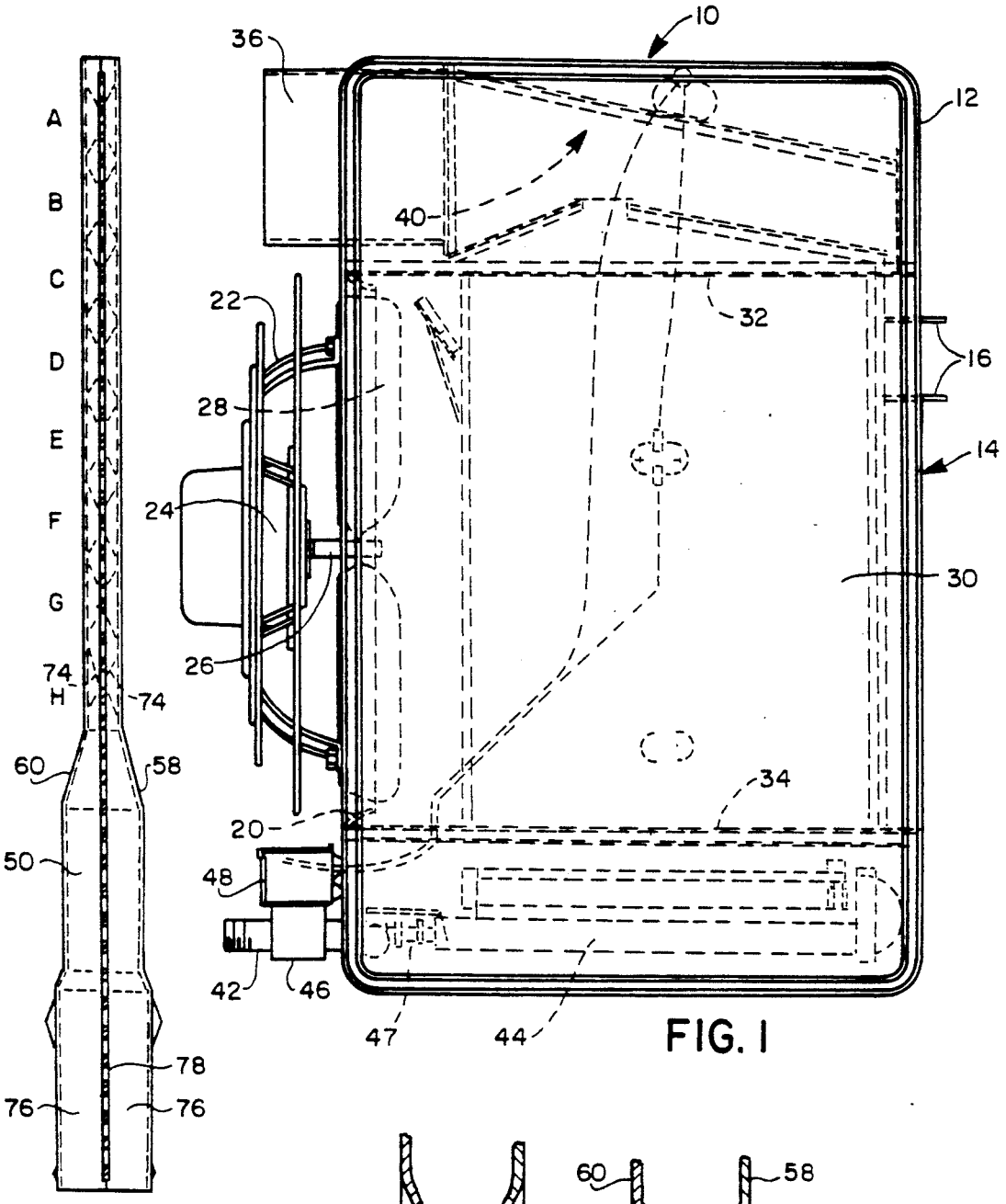
FIG. 1
FIG. 4
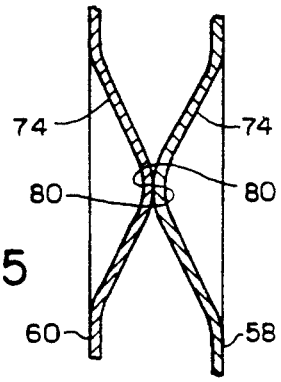
FIG. 5
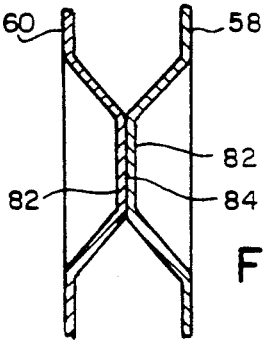
FIG. 6

UNIT HEATER AND HEAT EXCHANGER THEREFOR

FIELD OF THEE INVENTION

This invention relates to so-called "unit heaters" and more specifically, to an improved heat exchanger for use in a unit heater.

BACKGROUND OF THE INVENTION

So-called "unit heaters" have seen extensive use in commercial and industrial settings. They are relatively easy to install and provide relatively high quantities of heat for the space that they occupy.

In the usual case, such heaters include a heat exchanger made up of several parallel tubes. The tubes are typically arranged vertically and their lower sections are of relatively large cross section to be aligned with a burner or the like and act as a combustor. The resulting flue gases resulting from combustion then travel upwardly within each of the tubes through a narrowed section. After the flue gas has exited the tubes, it is typically conducted away to a vent. Air flowing past either section of the tube on the exterior thereof is heated by the hot walls of the tube.

The present invention is directed to providing a new and improved tube construction for use in a heat exchanger of the sort mentioned and which is particularly suited for use in an improved unit heater to provide improved heat transfer efficiency.

SUMMARY OF THE INVENTION

It is a principal object of the invention to provide a new and improved tube for use in a heat exchanger, the tube being of the type wherein combustion occurs in one section and flue gas resulting from the combustion is fed through a heat exchange section to heat air being flowed across the tube. More specifically, it is an object of the invention to provide a heat exchanger made up of a plurality of such tubes. It is also an object of the invention to provide a new and improved unit heater embodying such a heat exchanger.

A preferred embodiment of the invention contemplates a heat exchanger and combustor for exchanging heat between a forced air stream and flue gas generated by a plurality of spaced, parallel burners and including spaced, upper and lower headers. A plurality of tubes extend in parallel between and are mounted to the headers with opposed open ends at respective headers. Each tube has a first section of a large cross section adapted to serve as a combustor for fuel to generate the flue gas and a narrowed second section for exchanging heat between flue gas and the forced air stream. Each of the second sections includes generally flat, generally parallel spaced side walls and at least one of the side walls has dimples therein directed toward the other of the walls into proximity thereof.

In a highly preferred embodiment of the invention, each of the side walls has dimples therein directed toward the other of the walls. In a highly preferred embodiment, the dimples substantially fill the spaced walls of the second section.

The invention specifically contemplates that the dimples contact or almost contact the wall at which they are directed and where the dimples in one wall are aligned with the dimples in another wall, it is preferred that aligned dimples contact or almost contact each other.

Where contacting dimples are employed, it is preferred that at least some of the contacting dimples are secured to each other.

In a highly preferred embodiment, the dimples in each wall are arranged in a zig-zag pattern. Preferably, the zig-zag pattern is a honeycomb pattern.

The invention also contemplates a unit heater including a housing having an air inlet and an air outlet along with a fan or blower for driving air from the inlet to the outlet through a flow path. A plurality of parallel, spaced burners are located within the housing just below the flow path and the heat exchanger is disposed in the flow path and just above the burners. The heat exchanger includes a plurality of flattened, generally vertical tubes, one for each burner. Each tube has a relatively wide, open lower end overlying the associated burner and a narrower upper end in the flow path and is characterized by spaced, nominally parallel sides. Specifically contemplated as an improvement in the unit heater is the improvement wherein at least one side wall has a plurality of dimples directed towards the other side.

The invention also contemplates that the heat exchanger, or the heat exchanger of a unit heater have at least the first sections of some of the tubes provided with a convex dimple extending toward and nominally engaging the adjacent first section of the adjacent tube.

Other objects and advantages will become apparent from the following specification taken in connection with the accompanying drawing.

DESCRIPTION OF THE DRAWINGS

FIG. 1 is a side elevation of a unit heater made according to the invention;

FIG. 4 is a further enlarged elevation of a tube used in the heat exchanger;

FIG. 5 is an enlarged, fragmentary sectional view of one type of dimple employed in the tube; and FIG. 6 is a view similar to FIG. 5, but showing another type of dimple employed in the tube.

DESCRIPTION OF THE PREFERRED EMBODIMENT

Figure 3:
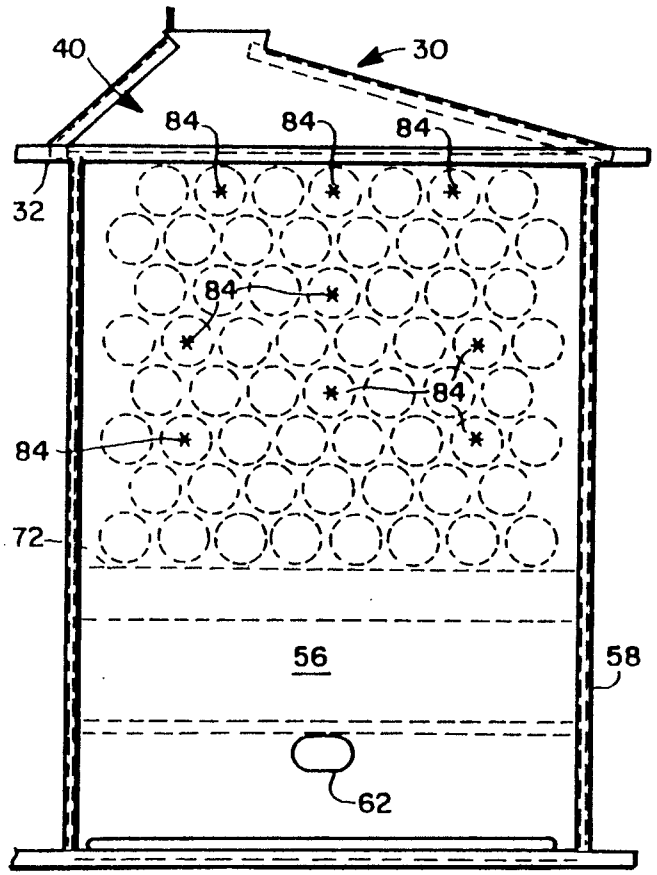
FIG. 3 is a side elevation of the heat exchanger taken from the right of FIG. 2.

An exemplary embodiment of a unit heater made according to the invention is illustrated in FIG. 1 and is seen to include a cabinet or housing, generally designated 10, of conventional construction. However, it is to be appreciated that the principles of the invention are not limited to use solely in unit heaters, but may be employed with efficacy in other types of furnaces as well. At its front side 12, the same includes a hot air outlet, generally designated 14, which may be provided with a series of pivoted louvers 16 for directional air flow as is well-known.

At its rear side 18, the housing 10 includes an inlet opening 20. A motor support 22 secured to the rear side 18 mounts a fan motor 24 having a shaft 26 mounting a fan blade 28 within the inlet opening for rotation therein. As is well-known, the fan made up of the motor 24 and blade 28 will force air through the housing 10 and out of the outlet 14.

The interior of the housing 10 is, in a large part, occupied by a heat exchanger, generally designated 30. The heat exchanger, to be described in greater detail hereinafter, includes an upper header 32 and a lower header 34 which delimit the top and bottom of a forced air flow path from the inlet 20 to the outlet 14.

The upper end of the housing 10 is provided with a vent connector 36 which may be connected to a vent or the like to convey gases of combustion thereto. The vent connector 36 is associated with a flue collector, generally designated 40, within the housing 10 and associated with the upper header 32.

A fuel pipe 42, for connection to a source of fuel such as natural gas, LP gas or the like, extends into the housing and is associated with a plurality of elongated, generally parallel burners 44. The association is via a suitable control valve or valves 46 and metering devices or orifices 47 which may be arranged in a conventional fashion. The housing 10 may also mount an electrical junction box 48 which may house controls for the motor 24 and the valve 46 as is well known.

Figure 2:
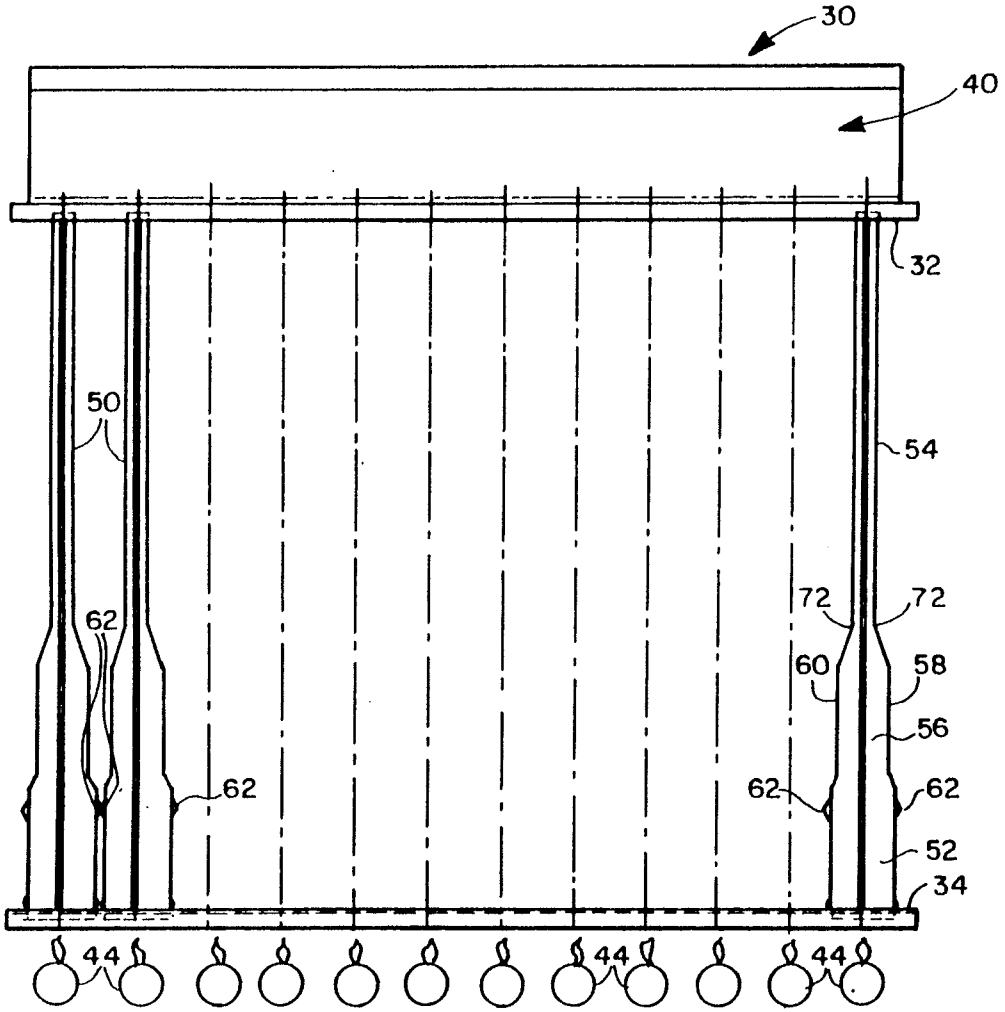
FIG. 2 is an enlarged, side elevation of a heat exchanger employed in the unit heater.

Turning now to FIGS. 2 and 3, the heat exchanger 30 will be described in greater detail.

As best seen in FIG. 2, the heat exchanger is made up of a plurality of tubes 50 extending between the headers 32 and 34 on the centers indicated. As can be ascertained by comparing FIGS. 2 and 3, the tubes 50 are of flattened cross section. The same include open lower ends 52 mounted to the lower headers 34 in any desired fashion. The lower ends 52 are relatively wide in comparison to the upper ends 54 and are adapted to overlie a corresponding one of the burners 44 to receive the fuel and primary air mix emanating from the associated burner as well as such secondary air as may enter the open lower end 52. Thus, combustion occurs within the enlarged lower ends 52 of each of the tubes 50 such that the lower ends 52 act as a combustor section in each of the tubes 50. Typically, the configuration of the lower ends 52 will be any one of those well-known, conventional configurations that assures complete combustion of the fuel within the combustor section defined thereby and avoids the generation of carbon monoxide.

For ease of reference, the just described combustor sections of the tubes 50 will be given the reference numeral 56 and as can be seen in FIGS. 2 and 3, each side wall 58 or 60 of the combustor section 56 includes a convex dimple 62. The dimples 62 are directed toward the adjacent side wall 58 or 60 of the immediately adjacent tube 50 and are in nominal contact with each other as can be seen at the lower left end of FIG. 2.

The purpose of the dimples 62 is to maintain spacing between the combustor sections 56 of adjacent tubes 50 during a heat exchange operation. Specifically, as is well-known, the tubes 50 will typically be made of sheet metal and as they heat up or cool down, they may tend to move as a result of thermal expansion. If such were to occur with the side wall 58 of one tube moving toward the adjacent side wall 60 of an adjacent tube, and the dimples 62 were not present, the airflow space between those side walls could become blocked, wholly or partially, and that would impede heat transfer efficiency since the surface associated with the blocked passage would effectively be taken out of the heat transfer operation. Furthermore, it is possible that localized overheating could result in such a situation, raising the possibility of damage to the heat exchanger. These consequences are, however, avoided through the use of the dimples 62 which maintain proper spacing.

Above the combustor section 56, each tube 50 includes a heat exchanger section 70. The heat exchanger section 70 is intended to exchange heat between flue gas passing upwardly within the associated tube 50 and air being driven from the inlet 20 to the outlet 14 by the fan 24, 28. The heat exchange section 70 is delimited by that part of each tube 50 extending downwardly from the upper header plate 32 to the point or line 72 in each wall 58 or 60 whereat the walls 58 and 60 begin to diverge to define the combustor section 56. The walls 58 and 60 of each tube 50, in the heat exchanger section 70, are substantially filled with a plurality of concave dimples, the outlines of which are shown at 74 in FIG. 3. The dimples 74 are arranged, from top to bottom of the heat exchanger, in a zig-zag fashion which may be more aptly termed a honeycomb pattern. It bears repeating that the pattern of dimples 74 substantially fills each of the sidewalls 58 and 60 which is to say that there is substantially no room left in such walls for any additional complete dimples.

As can be seen in FIG. 4, each tube 50 may be made up of two tube halves 76 that are identical to each other and joined together at 78.

In the embodiment illustrated in FIGS. 3 and 4, from top to bottom, there are eight horizontal rows of the dimples 74, which rows are designated A, B, C, D, E, F, G and H.

FIG. 4 illustrates that both of the sides 58 and 60 of a tube 50 are provided with the dimples 74 with the dimples in one wall 58 being aligned with the dimples 74 in the other wall 60.

The dimples 74 thus are directed towards the opposite wall and it is preferred that they extend into contacting or almost contacting relation with the other wall which is to say, the aligned dimple formed in the other wall.

FIG. 5 illustrates a typical dimple 74 which may be basically conical or even slightly spherical if desired. Apexes 80 of the aligned dimples 74 are touching or almost touching. Generally speaking, it will be desired that there be actual contact between the aligned dimples in the higher rows such as rows A, B and C while some spacing between aligned dimples 74 may be present in one or more of the lowermost rows. Thus, in FIG. 4, the dimples in row H are shown to be slightly spaced.

In some instances, dimples will be formed with flat bottoms as illustrated at 82. In this case, the flat bottoms 82 of aligned dimples are in engagement with one another and are secured to each other, as, for example, by a spot weld 84. This construction provides dimensional stability during operation in terms of resisting warping or oil-canning of the walls 58, 60 due to internal thermal stress. The location of dimples 74 bearing spot welds 84 is shown in FIG. 3. At each of these locations, in a preferred embodiment of the invention, the depth of each dimple is chosen to be 0.350 inches. This dimension is also held for all of the dimples in rows A, B and C. The dimples 74 in row D that lack spot welds 84 have a corresponding dimension of 0.325 inches while a return is made to the 0.350 inch dimension in row E. Dimples in row F that are not flat bottomed dimples (spot welded) have a corresponding dimension of 0.290 inches while the dimple depth of the dimples in row G, from left to right alternates at 0.350 to 0.300 inches.

All dimples in row H have a depth of 0.240 inches.

The purpose of causing the dimples 74 to contact or almost contact the wall that they face is to minimize the area for passage of a flue gas between the apex 80 of a dimple and the wall that it faces. Thus, given the zig-zag configuration of the dimples, the flue gas is forced to pass in a tortuous path, thereby increasing its turbulence and enhancing heat transfer from the gas to the tubes 50.

The reason that more contact between facing dimples near the upper end of the tubes 50 is provided as a result of the greater depth of each dimple than at a lower level is to occlude somewhat more of the overall cross sectional area of the interior of the tubes with dimples to continue to force the gas in a tortuous path. It will be appreciated that as the gas moves upwardly within the tubes 50, it is cooling and thus its volume will be reduced. The increased contact between dimples at the upper ends of the tubes thus reduces cross sectional area to compensate for the fact that the volume of the gas is simultaneously decreasing as well.

A heat exchanger made according to the invention has been determined to increase heat transfer to air being flowed across the tubes 50 in the range of 3 to 8 percent for the same burner setting utilizing conventional tubes heretofore employed in unit heaters manufactured by the assignee of the instant application. The actual percentage within the range depends, of course, on the specific burner setting chosen.

It is believed that this increase is due to both the turbulence induced by forcing the flue gas to follow a tortuous path which thus increases the heat transfer coefficient on the flue gas side as well as as a result of the fact that forming the dimples in the walls of the tubes actually increases the surface area exposed to the flue gas to some degree. In any event, it will be appreciated that the use of dimples in a heat exchanger made according to the invention provides a measurable and tangible increase in heat transfer efficiency.

We claim:

1. A furnace including a housing having an air inlet; an air outlet;

a fan or blower for driving air from the inlet to the outlet through a flow path, a plurality of parallel, spaced burners within the housing just below the flow path burners and including a plurality of flattened, generally vertical tubes, one for each burner, each tube having a relatively wide, open lower end overlying the associated burner and a narrower upper end in said flow path and characterized by space, generally parallel sides, the improvement wherein at least one side as a plurality of dimples directed toward the other side, the dimples contacting or almost contacting the other side and substantially filling said one said above said relatively wide lower end, each of said lower ends, on both sides thereof, including a convex dimple extending toward and nominally engaging a corresponding convex dimple on the adjacent side of the adjacent tube.

2. A heat exchanger and combustor for exchanging heat between a forced air stream and flue gas exchanging heat between a forced air stream and flue gas generated by a plurality of spaced, parallel burners and comprising:

spaced upper and lower headers; and a plurality of tubes, one for each burner, extending in parallel between and mounted to said headers and with opposed open ends at respective headers;

each tube having a first section of enlarged cross section adapted to serve as a combustor for fuel to generate said flue gas, and a narrowed second section for exchanging heat between flue gas and said forced air stream;

each said second section including generally flat, generally parallel, spaced walls, each said wall having dimples therein directed toward an aligned dimple in the other wall and into contacting or almost contacting relation therewith;

at least some of said tubes at their first sections including a dimple directed toward the first section of the adjacent tube and into nominal contact therewith.

3. The heat exchanger of claim 2 wherein said dimples are in a honeycomb pattern substantially filling said walls of said second section.

4. The heat exchanger of claim 2 wherein said dimples directed toward the first section of the adjacent tube are located generally centrally of their respective first sections.

5. A furnace including a housing having an air inlet; and air outlet;

a fan or blower for driving air from the inlet to the outlet through a flow path, a plurality of parallel, spaced burners within the housing just below the flow path burners and including a plurality of flattened, generally vertical tubes, one for each burner, each tube having a relatively wide, open lower end overlying the associated burner and a narrower upper end in said flow path and characterized by space, generally parallel sides, the improvement wherein at least one side as a plurality of dimples directed toward the other side, the dimples contacting or almost contacting the other side and substantially filling said one said above said relatively wide lower end, some of said dimples contacting each other and the other of said dimples almost contacting each other; and there are more contacting dimples near the upper ends of the tubes then at a lower level thereon.

* * * * *

UNITED STATES PATENT AND TRADEMARK OFFICE

CERTIFICATE OF CORRECTION

PATENT NO. : 5,333,598 
DATED : August 2, 1994
INVENTOR(S) : Richard A. Mielke, Norman E. Mattson and Robert S. Cooley It is certified that error appears in the above-identified patent and that said Letters Patent is hereby corrected as shown below:

Column 5,
Lines 11 and 46, change “space” to -- spaced --.
Lines 12 and 47, change “as” to -- has --.
Lines 15 and 50, change “said” (second occurrence) to -- side --.
Line 41, delete “burners”.

Column 6,
Lines 12 and 43, change “space” to -- spaced --.
Lines 16 and 47, change “said” (second occurrence) to -- side --.
Lines 21 and 52, change “then” to -- than --.
Line 37, delete “burners”.
Line 44, change “as” to -- has --.

Signed and Sealed this

Twenty-sixth Day of August, 2003

JAMES E. ROGAN
*Director of the United States Patent and Trademark Office*